US005518328A

United States Patent [19]

Okuchi et al.

[11] Patent Number: 5,518,328

[45] Date of Patent: May 21, 1996

[54] TAPE UNIT

[75] Inventors: Hiroyuki Okuchi, Nagoya; Koshiro Yamaguchi, Kasugai, both of Japan

[73] Assignee: Brother Kogyo Kabushiki Kaisha, Nagoya, Japan

[21] Appl. No.: 273,916

[22] Filed: Jul. 12, 1994

[30] Foreign Application Priority Data

Jul. 23, 1993 [JP] Japan ..... 5-182597

[51] Int. Cl.[6] ..... B41J 35/28

[52] U.S. Cl. ..... 400/208; 400/249; 400/703; 400/246

[58] Field of Search ..... 400/207, 208, 400/249, 613, 703, 246, 719

[56] References Cited

U.S. PATENT DOCUMENTS

| | | | |
|---|---|---|---|
| 4,747,716 | 5/1988 | van der Eikel | 400/249 |
| 4,861,177 | 8/1989 | Heins et al. | 400/208 |
| 4,907,902 | 3/1990 | Doi | 400/703 |
| 5,087,137 | 2/1992 | Burnard et al. | 400/249 |
| 5,277,503 | 1/1994 | Nagao | 400/208 |
| 5,290,114 | 3/1994 | Asami et al. | 400/703 |
| 5,333,959 | 8/1994 | Yamaguchi et al. | 400/208 |
| 5,352,049 | 10/1994 | Shiraishi et al. | 400/208 |

FOREIGN PATENT DOCUMENTS

| | | | |
|---|---|---|---|
| 237970 | 10/1988 | Japan | 400/613 |
| 4163679 | 6/1992 | Japan | 400/613 |

*Primary Examiner*—Ren Yan
*Attorney, Agent, or Firm*—Oliff & Berridge

[57] ABSTRACT

An object of the invention is to offer tape units having a plurality of kinds of tapes and to be reloaded to corresponding tape cassettes, and when the tape unit is to be reloaded, the kind of tape unit to be reloaded can be discriminated at a single glance and the tape unit can be reloaded in a proper state to the corresponding tape cassette without fail. A cap is fitted in a spool hole disposed on the upper end part of a tape spool of each tape unit, and there is a display for displaying the ground color of a tape, a color which can be colored in printing, the use of the tape and the width of the tape provided on the upper surface of the cap. Thus, the characteristic of each tape can be recognized at a single glance, and reloading can be performed properly in selecting a desired tape unit.

29 Claims, 10 Drawing Sheets

TAPE UNIT

BACKGROUND OF THE INVENTION

1. Field of the Invention

The present invention relates to a tape unit to be housed in a tape cassette to be applied to a tape printer for manufacturing a tape with characters which is used being affixed on the back of a video cassette, etc., in particular, it relates to a tape unit which is reloadable on a tape cassette and which can be properly reloaded on a tape cassette main body without mistaking a tape unit to be reloaded for a wrong one in the case of reloading of a tape unit.

2. Description of Related art

Concerning tape cassettes to be used for a tape printer, it is desirable to use different tapes having different tape widths or tape colors. Therefore, a plurality of kinds of tape cassettes have been prepared corresponding to the tapes having a plurality of kinds of tape widths or tape colors. Tapes to be housed in tape cassettes are wound in roll shapes, respectively. A tape has a lamination structure of four layers: a thermosensitive agent layer which can be colored by the heat of a thermal head is formed on a surface of a tape base and on the other surface of the tape base, a releasable paper is placed through an adhesive agent layer. In order to manufacture a tape with characters using such a tape, a part of the roll-shaped tape is pulled out until it reaches a thermal head and heat control is performed selectively by the thermal head on the side of the thermosensitive agent layer and a tape with characters is manufactured, the tape which has characters, etc. formed by coloring on the thermosensitive agent layer.

In the case of such conventional tape cassettes, no consideration is given to the rehousing of a new tape to a cassette case when a tape is used up and, therefore, when a housed tape is used up, the cassette case itself loses its use value and is discarded.

In the case of a conventional tape cassette, even when a tape housed in the tape cassette is used up, the cassette case itself is still worthy for use and, therefore, it is a waste to discard the cassette case simply because of the reason why a tape housed in the tape cassette is used up and also it is a cause to raise the cost in manufacturing tapes. Moreover, in recent years the protection of environment is called for from a social point of view, and when it is considered that, generally, cassette cases are made of resin such as plastic, there is much fear that discarded cassette cases may cause a result against the protection of environment if a cassette case is discarded every time a tape housed in it is used up, which does not meet the tendency of the time.

SUMMARY OF THE INVENTION

Thereupon, it can be considered to form a tape spool for a tape cassette and a tape wound on it into one unit and to arrange the unit to be exchangeable for a tape cassette main body. Hereinafter, a unit composed of a tape spool and a tape wound around it will be called a tape unit. A plurality of kinds of tape units are prepared by the use objects.

A tape unit has a simple structure, and it is a desirable condition that a tape unit can be interchangeable with another tape unit for the identical tape cassette, so that all tape units have to have similar shapes; therefore, it has been difficult to discriminate a desired tape unit out of a plurality of tape units.

Since the shape of a tape unit is simple, when it is replaced with a new one, there is a fear that a tape unit may be loaded in a reverse direction in mistaking top for bottom. If a tape unit is wrongly loaded, a releasable paper side, not a thermosensitive agent layer side, will make contact with a thermal head, and thereby, it is made impossible to perform proper printing and a part of the tape which is wrongly printed is wasted. Accordingly, it has been essential for a user to confirm carefully the top and bottom of a tape unit.

The present invention was invented for the purpose of solving the problem as described above, and the object of the invention is to offer a tape unit which can be properly reloaded for a corresponding tape cassette being able to discriminate a tape unit to be reloaded from other tape units at a single glance when a tape unit is replaced with a new one.

In order to achieve the above-mentioned object, a tape unit according to the present invention comprises a tape spool having a spool hole in the inside and a tape wound around the tape spool so that the tape unit can be rotatably engaged with a tape supporting shaft provided in a standing state on the bottom surface of the tape cassette, and the tape spool is arranged to be interchangeable for a tape cassette, and moreover, a display member for displaying the kind of wound tape is provided in a part of the tape unit.

The above-mentioned display member is a cap-shaped member to be fitted in a spool hole provided in the upper end part of the tape spool, and the ground color of a tape, the color to be colored in printing, the use of a tape or the width of a tape may be displayed on the upper surface of it.

In the case of a tape unit according to the present invention having a constitution as described above, when a tape of a tape unit housed in a tape cassette main body is used up or when a user wants to print on a tape of the other kind corresponding to a use object, a tape unit with a new tape is loaded in place of a tape unit which is presently loaded. In such a case, since the kind of wound tape is displayed on a display member being fixed to a part of the tape unit, a tape unit of a desired kind can be easily selected, which makes it possible to securely prevent the loading of a wrong tape spool.

DETAILED DESCRIPTION OF PREFERRED EMBODIMENTS

Figure 1:
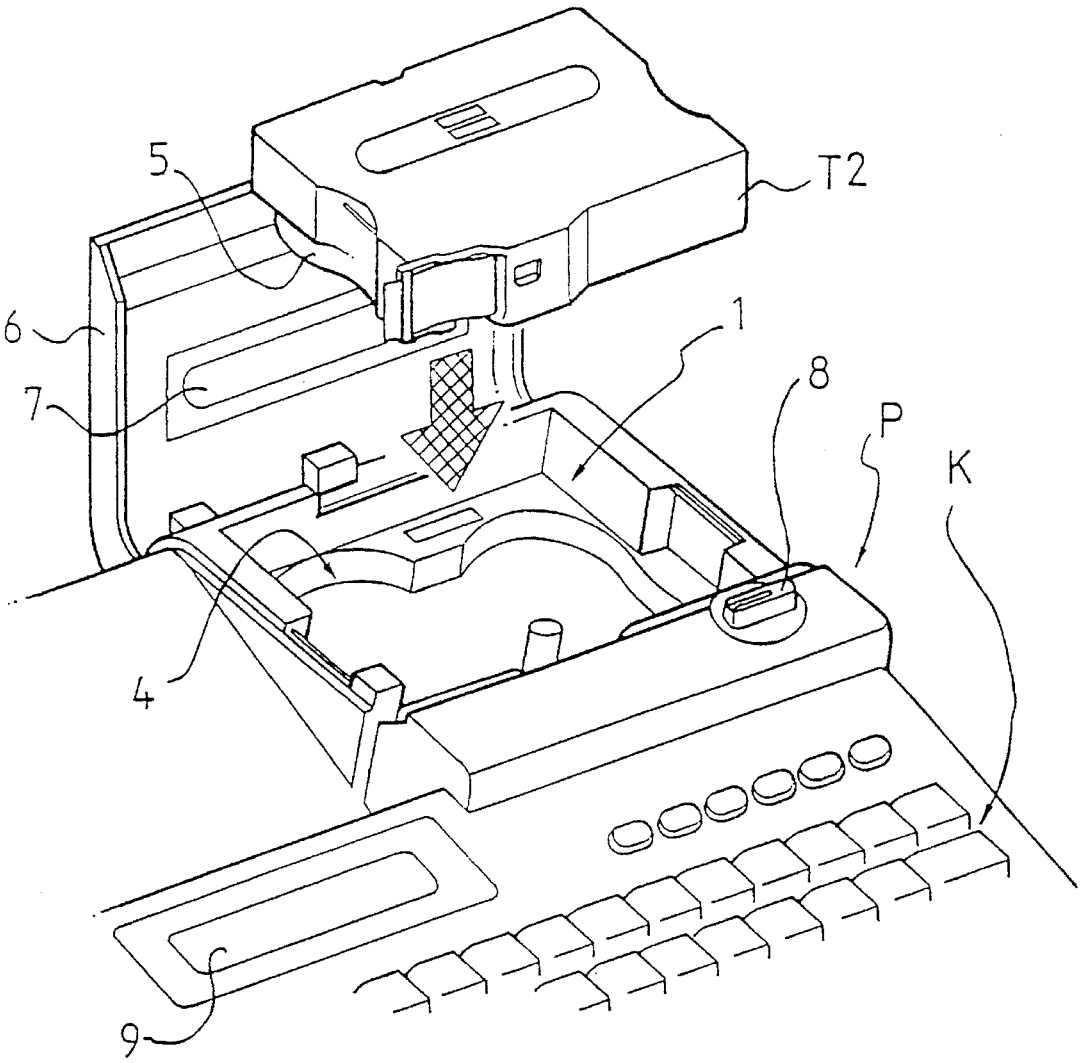
FIG. 1 is a partial perspective view showing a tape cassette installation portion in a tape printer.

Preferred embodiments according to the present invention will be explained in detail referring to drawings in the following. The outline of a tape printer in which a tape cassette according to the present invention is used will be explained based on FIGS. 1 and 2. FIG. 1 is a partial perspective view showing a tape cassette installation portion in a tape printer, and FIG. 2 is an enlarged plan view of the tape cassette installation portion.

In these figures, a tape cassette installation portion 1 for installing a plurality of kinds of tape cassettes is provided in the rear part on the right side of a tape printer P. In the present embodiment, there are two kinds of tape cassettes to be explained later: one is a narrow tape cassette T1 for housing a narrow tape and the other is a wide tape cassette T2 for housing a wide tape. In FIG. 1, a wide tape cassette T2 is shown.

Figure 2:
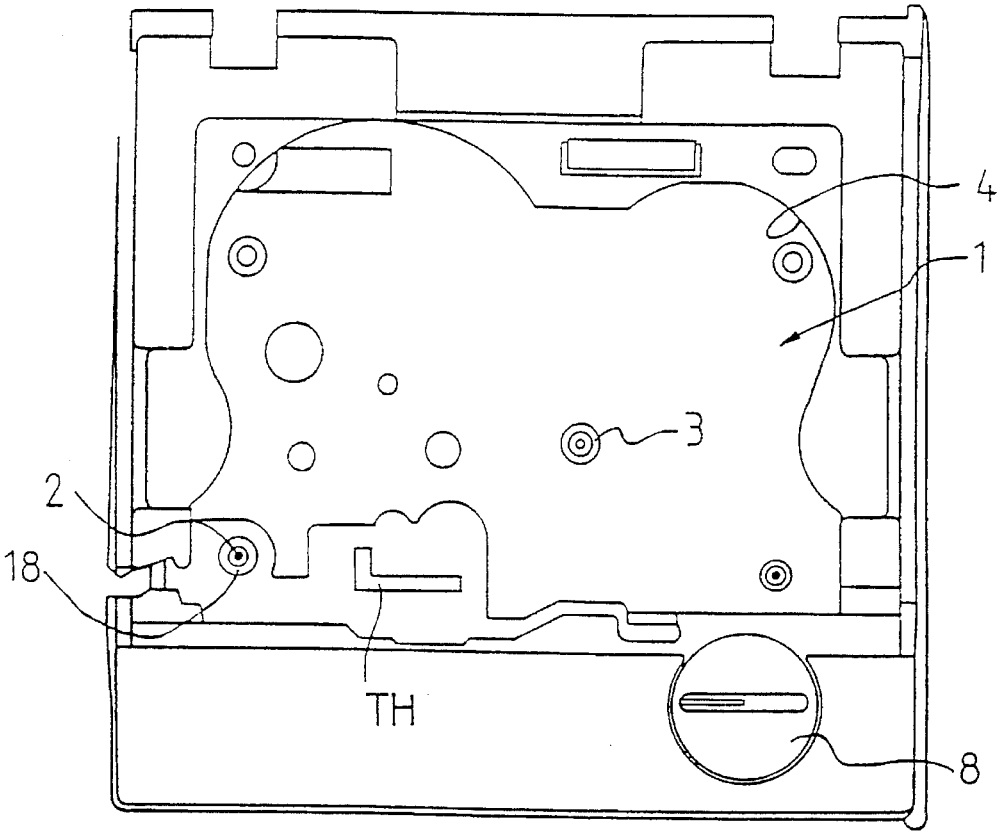
FIG. 2 is an enlarged plan view of the tape cassette installation portion.

In the tape cassette installation portion 1, as shown in FIG. 2, a tape feed shaft 2 to be driven rotatively by a tape feed motor, not shown, is disposed in the lower part on the left side of the tape cassette installation portion 1. A tape feed shaft 18 is fixed to the tape feed shaft 2, and when the tape cassette T1 or T2 is installed in the tape cassette installation portion 1, it is engaged with a tape feed roller 19 which is disposed rotatably inside the tape cassette T1 or T2, respectively (refer to FIG. 5), and when the tape cassette T1 or T2 is installed in the tape cassette installation portion 1, the tape feed roller 19 performs tape feed operation of a tape T, which is housed inside the tape cassette T1 or T2 in cooperation with a tape feed auxiliary roller, not shown, provided in the tape printer being disposed facing the roller 19. A driving shaft 3 which is rotated interlocking with the tape feed shaft 2 through a gear mechanism, etc., not shown, is disposed in the neighborhood of the central part of the tape cassette installation portion 1, and a sound suppressing spool 20 being provided inside the tape cassette T1 or T2 (refer to FIG. 5) is engaged with the driving shaft 3. The driving shaft 3 is used as a take up shaft of a thermal ribbon housed in a conventional tape cassette, but in the case of the tape cassette T1 or T2 according to the present embodiment, the driving shaft 3 is not concerned in the feeding operation of the tape T; therefore, the sound suppressing spool 20 is provided to decrease the noise generated with the rotation of the driving shaft 3. The feeding operation of the tape T housed in the tape cassette T1 or T2 is performed through the feed shaft 18 fixed to the tape feed shaft 2, the tape feed roller 19 and the tape feed auxiliary roller.

A step portion 4 (refer to FIG. 1) is formed in the tape cassette installation portion 1, to receive a protruding portion 5 (explained later) formed on the bottom surface of the wide tape cassette T2 when it is installed on the tape cassette installation portion 1.

At the rear position of the tape cassette installation portion 1 being constituted as described above, a lid 6 is fixed to the tape printer P to be opened or closed for it. A window 7 is formed in the approximately central part of the lid 6. The window 7 is provided to visually confirm the kind of tape cassette (the narrow tape cassette T1 or the wide tape cassette T2) installed in the tape cassette installation portion 1. A rotary lock member 8 is provided at the front position of the tape cassette installation portion 1, and the rotary lock member 8 controls the opening and the closing of the lid 6 through a lock mechanism, not shown. Further, in front of the tape cassette installation portion 1, a keyboard K having a variety of keys is provided, and a liquid crystal display 9 is disposed off to the upper of the keyboard K. With these arrangements, characters, symbols, etc. input by the keys on the keyboard K are displayed on the liquid crystal display 9, whereby the editing of characters, etc. to be printed on the tape T through a thermal head TH (see FIG. 2) can be performed.

Figure 3:
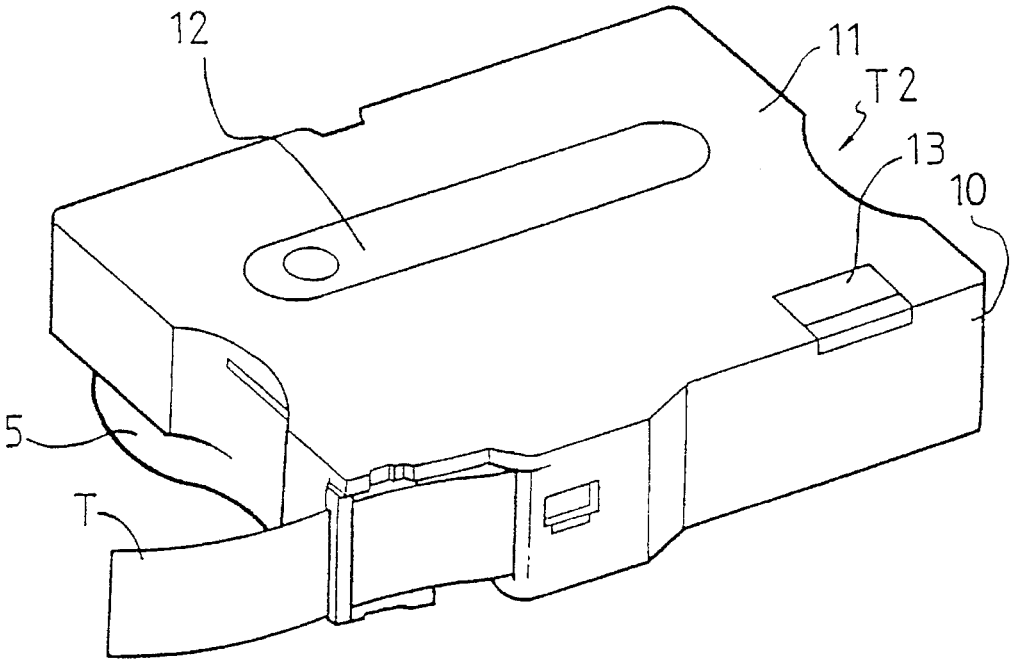
FIG. 3 is a perspective view of a wide tape cassette.
Figure 4:
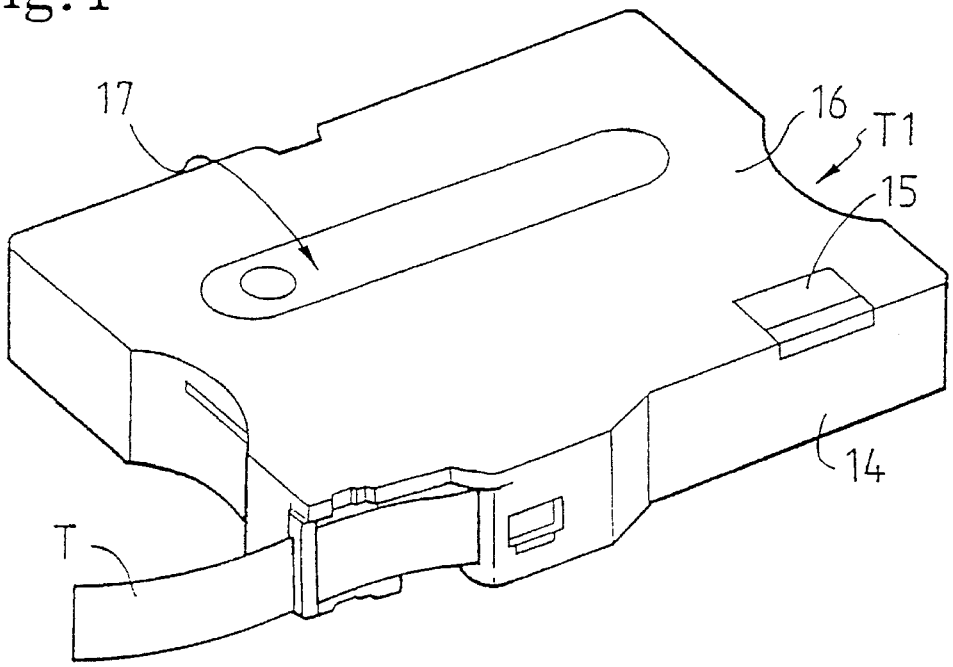
FIG. 4 is a perspective view of a narrow tape cassette.

Next, the two tape cassettes T1 and T2 in the present embodiment will be explained in reference to FIGS. 3 and 4. At first, the wide tape cassette T2 will be explained referring to FIG. 3. FIG. 3 is a perspective view of the wide tape cassette T2. The wide tape cassette T2 is composed of a cassette main body 10 and a cassette lid 11 which is disposed to be attachable to or detachable from on the cassette main body 10 through an attachable/detachable portion 13, a claw member, or the like. At the central position of the cassette lid 11, a tape confirmation portion 12 being made of a transparent resin plate is provided corresponding to the window 7 formed on the lid 6 of the tape cassette installation portion 1. With the window 7 on the lid 6 and the tape confirmation portion 12, it is made possible to confirm from the outside of the printer P the quantity of the tape T housed in the tape cassette T2, the color of characters, etc. on the tape T to be formed by coloring. As described above, the protruding portion 5 is formed on the bottom surface of the cassette main body 10, and the protruding portion 5 is to be fitted in the step portion 4 provided on the tape cassette installation portion 1. About the internal constitution of the wide tape cassette T2, explanation will be given later.

Next, the narrow tape cassette T1 will be explained referring to FIG. 4. FIG. 4 is a perspective view of the narrow tape cassette T1. The narrow tape cassette T1 is, similar to the wide tape cassette T2, composed of a cassette main body 14 and a cassette lid 16 which is disposed to be attachable to or detachable from on the cassette main body 14 through an attachable/detachable portion 15, a claw member, or the like. At the central position of the cassette lid 16, similar to the above case, a tape confirmation portion 17 being made of a transparent resin plate is provided corresponding to the window 7 formed on the lid 6 of the tape cassette installation portion 1. Owing to the window 7 on the lid 6 and the tape confirmation portion 17, it is made possible to confirm from the outside of the printer P the quantity of the tape T housed in the tape cassette T1, the color of characters, etc. to be colored on the tape T in printing. Different from the case of the wide tape cassette T2, since the width of the tape T to be housed in the cassette main body 14 is narrow, there is no such portion corresponding to the protruding portion 5 on the bottom surface of the narrow tape cassette T1. Therefore, when the narrow tape cassette T1 is installed on the cassette tape installation portion 1, the step portion 4 does not play any part in that operation. The internal structure of the narrow tape cassette T1 will be described later. The above-mentioned tape confirmation portion 12 or 17 has a shape of a slotted hole to be able to see the inside of the tape cassette T1 or T2.

Figure 5:
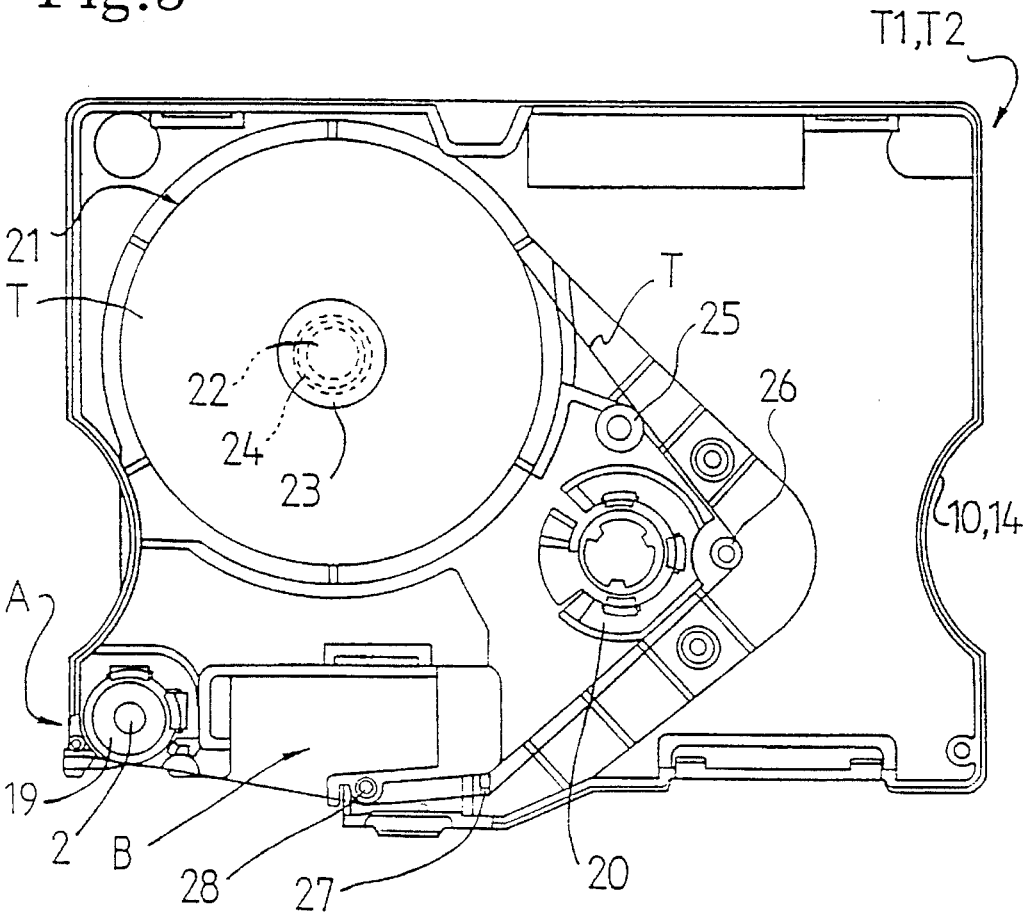
FIG. 5 is a plan view showing the tape cassette in a state where a cassette lid is taken off.
Figure 6:
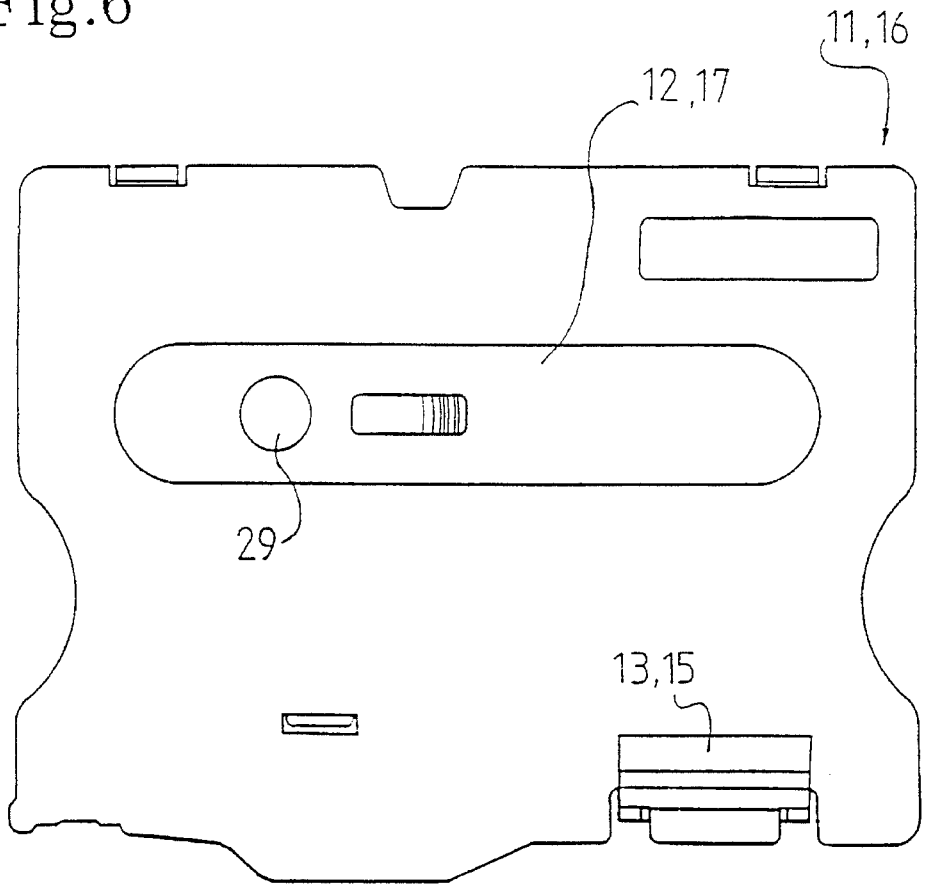
FIG. 6 is a plan view of the cassette lid.

Next, the internal structure of the wide tape cassette T2 and that of the narrow tape cassette T1 will be explained in reference to FIG. 5 through FIG. 11. At first, a part of the structure of the narrow tape cassette T1 which is in common with that of the wide tape cassette T2 will be explained referring to FIG. 5 through FIG. 7. FIG. 5 is a plan view showing the tape cassette T1 or T2 excluding the cassette lid 11 or 16; FIG. 6, a plan view of the cassette lid 11 or 16; and FIG. 7, an illustrative representation showing the constitution of the tape T.

As shown in FIG. 5, a tape housing portion 21 is formed at the left upper position of the cassette main body 10 or 14, and a tape supporting shaft 22 (refer to FIGS. 9 and 11) is formed at the central position on the bottom wall of the tape housing portion 21. A tape spool 23, having the tape T wound around it, is rotatably engaged with the tape supporting shaft 22 through a spool hole 24. The tape T wound on the tape spool 23 housed in the tape housing portion 21 is guided toward a tape discharge portion A through tape guides 25, 26, 27 and 28, and discharged to the outside of the tape cassette T1 or T2 by the cooperation of the tape feed shaft 18 fixed on the tape feed shaft 2, the tape feed roller 19 coupled with the tape feed shaft 18 and the tape feed auxiliary roller, being disposed in the vicinity of the discharge portion A. The thermal head TH which is provided in a standing state in the tape cassette installation portion 1, as shown in FIG. 2, is inserted into a depressed portion B provided in the vicinity of the tape guide 28 when the tape cassette T1 or T2 is installed in the tape cassette installation portion 1; the tape T is discharged by the tape feed roller 19, etc. after characters, etc. are printed on the tape T by the thermal head TH.

As shown in FIG. 6, a visual confirmation portion 29 for visually confirming the upper surface of a cap 30 (described later) to be engaged with the top part of the tape spool 23 is provided in the confirmation portion 12 or 17, which is provided on the cassette lid 11 or 16, respectively; thus the cap 30 positioned on the top of tape spool 23 can be visually confirmed through the visual confirmation portion 29. The color information about the possible coloring of the tape T wound around the tape spool 23 is given on the cap 30 of the tape spool 23, as described later.

Figure 7:
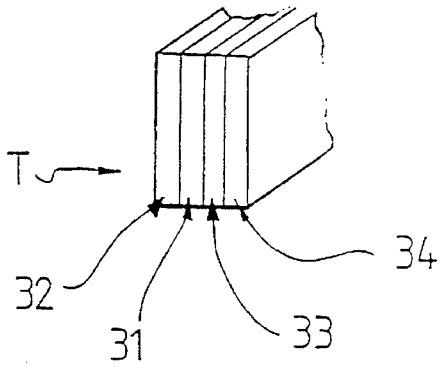
FIG. 7 is an illustrative representation showing the constitution of a tape.

As shown in FIG. 7, the tape T to be housed in the tape cassette T1 or T2 has a laminated structure of four layers: a thermosensitive agent layer 32 which can be colored by heat given by the thermal head TH is formed on the surface of a tape base 31, and a releasable paper 34 is applied through an adhesive agent layer 33 on the other surface of the tape base 31. In order to manufacture a tape with characters using the tape as described in the above, heating control is performed selectively by the thermal head TH on the side of the thermosensitive agent layer 32 and characters, etc. are formed by the coloring of the thermosensitive agent layer 32. The tape such constituted as described above is wound around the tape spool 23 so that the thermosensitive agent layer 32 is positioned facing the inside, which makes it possible to protect the thermosensitive agent layer 32 from heat or light.

Figure 8:
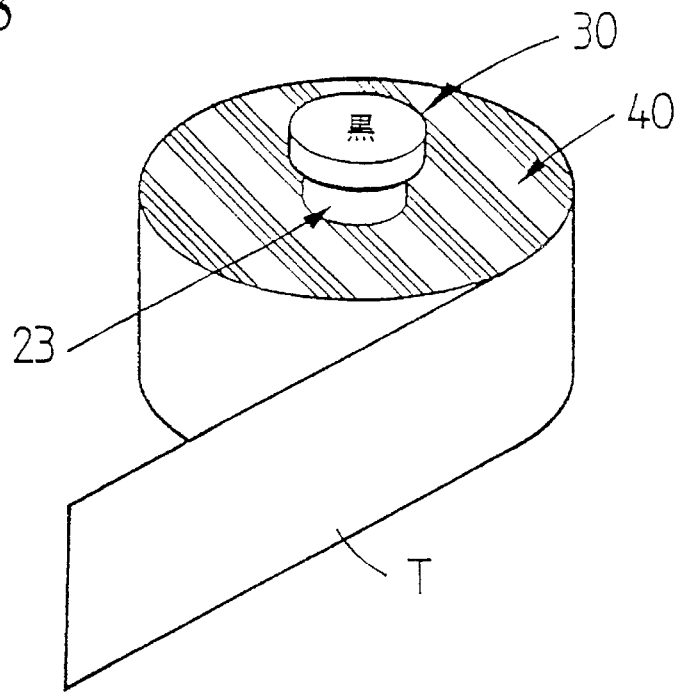
FIG. 8 is a perspective view showing a state where the tape is wound around a tape spool in the wide tape cassette.
Figure 9:
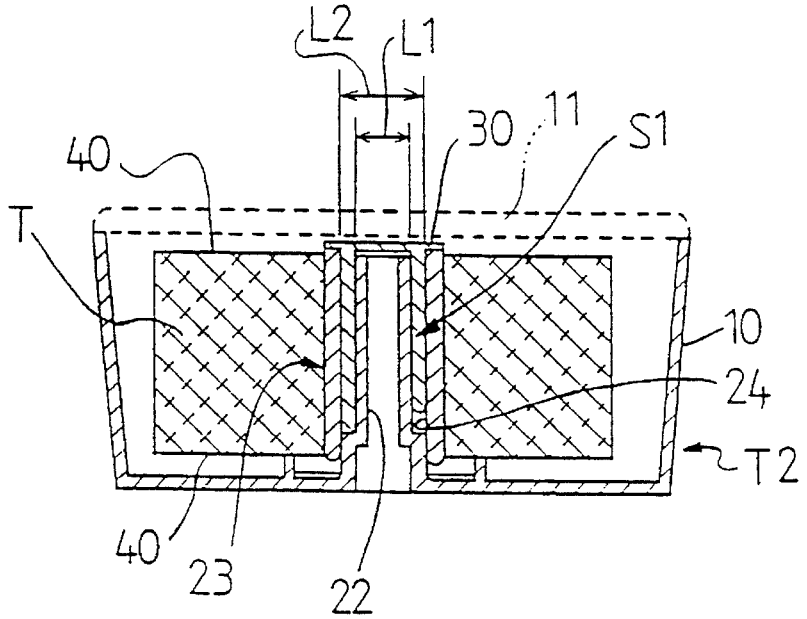
FIG. 9 is a cross sectional view showing a state of the wide tape cassette in which the tape is housed.

Next, the tape spool 23 and the tape T to be housed in the tape housing portion 21 of the cassette main body 10 in the case of the wide tape cassette T2 will be explained referring to FIGS. 8 and 9. FIG. 8 is a perspective view showing a state where the tape T is wound around the tape spool 23, and FIG. 9 is a cross sectional view showing a state of the tape cassette T2 in which the tape T is housed. As shown in these figures, the spool hole 24 is formed at the center of the tape spool 23, and the inner diameter of the spool hole is set to be L2. The outer diameter of the tape supporting shaft 22 which is provided in a standing state on the bottom surface of the cassette main body 10 is set to be L1. The cap 30, on the top of the tape spool 23, is inserted into a gap S1 produced by the difference between the inner diameter L2 of the spool hole 24 and the outer diameter L1 of the tape supporting shaft 22. The wall thickness of the cap 30 is set to be (L2–L1) and it is to be inserted into the gap S1. The color of characters, etc. which can be colored on the tape T wound around the tape spool 23 is displayed on the upper surface of the cap 30 as shown in FIG. 8. The upper surface of the cap 30 can be confirmed from the outside of the tape printer P through the visual confirmation portion 29 in the confirmation portion 12 provided on the cassette lid 11 and the window 7 on the lid 6, which makes it possible to simply confirm the color of characters, etc. to be colored on the tape T housed in the tape cassette T2 from the outside of the printer P.

Moreover, seals 40 applied with an adhesive agent are stuck on the upper end surface and the lower end surface of the tape T so that the surfaces of the seals 40 applied with an adhesive agent can be stuck to the upper end surface and the lower end surface of the tape T (in FIG. 8, there is shown only the seal 40 stuck on the upper end surface of the tape T). The seals 40 are adapted to maintain the wound state of the tape T, preventing the tape T wound around the tape spool 23 from loosening.

Figure 10:
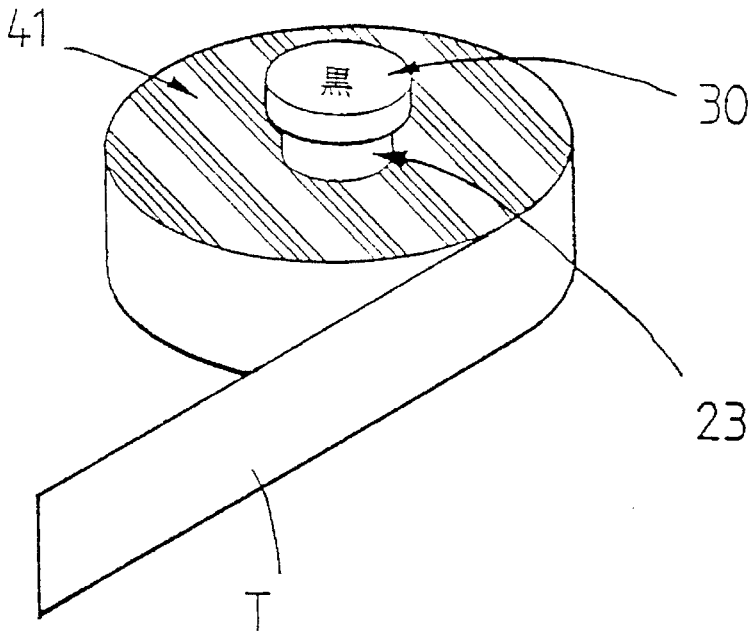
FIG. 10 is a perspective view showing a state where the tape is wound around the tape spool in the narrow tape cassette.
Figure 11:
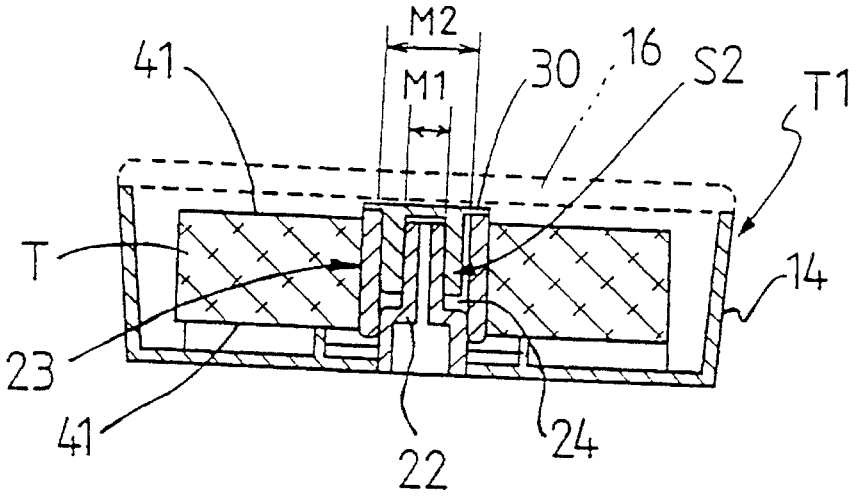
FIG. 11 is a cross sectional view showing the narrow tape cassette in which the tape is housed.

Next, the tape spool 23 and the tape T to be housed in the tape housing portion 21 of the cassette main body 14 in the case of the narrow tape cassette T1 will be explained referring to FIGS. 10 and 11. FIG. 10 is a perspective view showing a state where the tape T is wound around the tape spool 23, and FIG. 11 is a cross sectional view showing the tape cassette T1 in which the tape T is housed. As shown in respective figures, the spool hole 24 is formed at the center of the tape spool 23, and the inner diameter of the spool hole is set to be M2 and the outer diameter of the tape supporting shaft 22 which is provided in a standing state on the bottom surface of the cassette main body 10 is set to be M1. The cap 30 on the tape spool 23 is inserted into a gap S2 produced by the difference between the inner diameter M2 of the spool hole 24 and the outer diameter M1 of the tape supporting shaft 22. The thickness of the wall of the cap 30 is set to be (M2–M1), and the cap 30 is engaged with the gap S2 so that the tape spool 23 can be rotated on the tape supporting shaft 22.

The inner diameter M2 of the tape spool 23 in the case of the narrow tape cassette T1 is set to be equal to the inner diameter L2 of the tape spool 23 in the case of the wide tape cassette T2 (M2=L2); the outer diameter M1 of the tape supporting shaft 22 in the case of the narrow tape cassette T1 is set to be smaller than the outer diameter L1 of the tape supporting shaft 22 in the case of the wide tape cassette T2 (M1<L1). Therefore, the gap S2 produced between the tape spool 23 and the tape supporting shaft 22 in the case of the narrow tape cassette T1 is larger than the gap S1 produced between the tape spool 23 and the tape supporting shaft 22 in the case of the wide tape cassette T2; therefore, according to the difference between the gap S1 and the gap S2, the cap 30 to be engaged with the gap S2 is formed to have a wall thickness larger than that of the cap 30 to be engaged with the gap S1. The cap 30 to be used for the narrow tape cassette T1 cannot be engaged with the gap S1 in the case of the wide tape cassette T2, which securely prevents the cap 30 for the narrow tape cassette T1 from being erroneously engaged with the gap S1 in the case of the wide tape cassette T2.

Since the wall thickness of the cap 30 used for the wide tape cassette T2 is smaller than the gap S2 of the narrow tape cassette T1, the cap can be inserted into the gap S2 but, in that case, the cap 30 protrudes from the cassette main body 14 and it becomes impossible to fit the cassette lid 16 in the cassette main body 14. Therefore, in that case also, it is securely prevented to fit erroneously the tape spool 23 for the wide tape cassette T2 in the tape supporting shaft 22 of the narrow tape cassette T1. Therefore, in the installation of the tape spool 23, there can be no fear of mistaking the tape spool 23 for the wide tape cassette T2 for that for the narrow tape cassette T1, and vice versa.

As shown in FIG. 10, the color of characters, etc. to be colored on the tape T wound around the tape spool 23 is displayed on the upper surface of the cap 30. The upper surface of the cap 30, similar to the description in the above, can be confirmed from the outside of the tape printer P through the visual confirmation portion 29 in the confirmation portion 17 provided on the cassette lid 16 and the window 7 on the lid 6, which makes it possible to confirm simply the color of characters, etc. to be colored on the tape T from the outside of the printer P.

Moreover, as shown in FIG. 10, seals 41 applied with an adhesive agent are stuck to the upper and lower end surfaces of the tape T so that the surfaces applied with an adhesive agent of the seals 41 and the upper and lower surfaces of the tape T can be stuck to each other (in FIG. 10, only the seal 41 stuck to the upper end surface of the tape T is shown). The seal 41, similar to the seal 40, is used for maintaining a wound state of the tape T wound around the tape spool 23, preventing the tape T from loosening.

Figure 12:
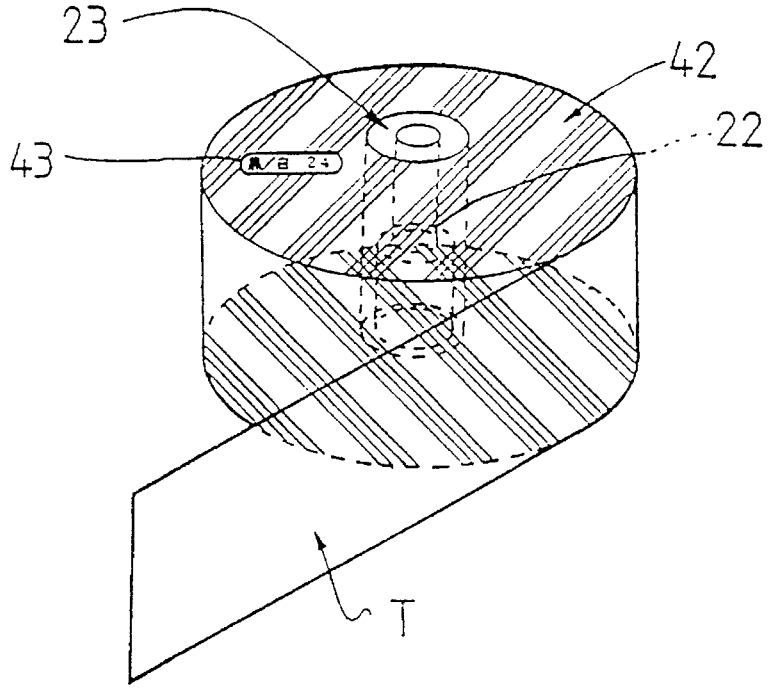
FIG. 12 is a perspective view showing a state where the tape is wound around another tape spool in the case of the wide tape cassette.
Figure 13:
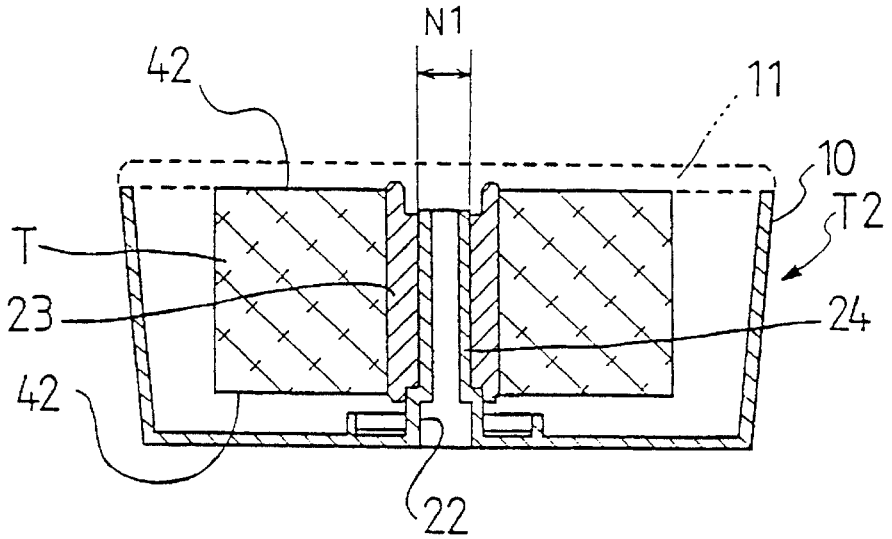
FIG. 13 is a cross sectional view showing a state of the wide tape cassette in which the tape wound around another tape spool is housed.

Next, another tape spool 23 and a tape T which can be housed in the wide tape cassette T2 or the narrow tape cassette T1 will be explained referring to FIG. 12 through FIG. 14. At first, the constitution of the tape spool 23 and the tape T which can be housed in a tape housing portion 21 for the wide tape cassette T2 will be explained referring to FIGS. 12 and 13. FIG. 12 is a perspective view showing a state where the tape T is wound around the tape spool 23, and FIG. 13 is a cross sectional view showing a state of the tape cassette T2 in which the tape T is housed.

In these respective figures, the inner diameter of a spool hole 24 formed at the center of the tape spool 23 is set to be N1 and the outer diameter of a tape supporting shaft 22 which is provided in a standing state on the bottom surface of a cassette main body 10 is also set approximately to be N1 (in the order that the tape spool 23 can be rotated on the tape supporting shaft 22). Seals 42 applied with an adhesive agent are stuck to the upper end surface and the lower end surface of the tape T so that the surfaces applied with an adhesive agent of the seals 42 and the upper and lower surfaces of the tape T can be stuck to each other. (In FIG. 12, only the seal 42 stuck to the upper end surface of the tape T is shown.) The seal 42 is applied for maintaining a wound state of the tape T, preventing it from loosening similar to the case described in the above. Further, as shown in FIG. 12, a display portion 43 which displays the color of possible coloring on the tape T wound around the tape spool 23, etc. is formed on the seal 42 stuck on the upper end surface of the tape T. Therefore, it is made possible to reload the tape T which meets the tape cassette T2 without fail by the confirmation of the kind of tape in the display portion 43 when the tape T is to be reloaded.

Next, the constitution of the tape spool 23 and the tape T which can be housed in the tape housing portion 21 for the narrow tape cassette T1 will be explained referring to FIG. 14. FIG. 14 is a cross sectional view showing a state of the tape cassette T1 in which the tape T is housed.

Figure 14:
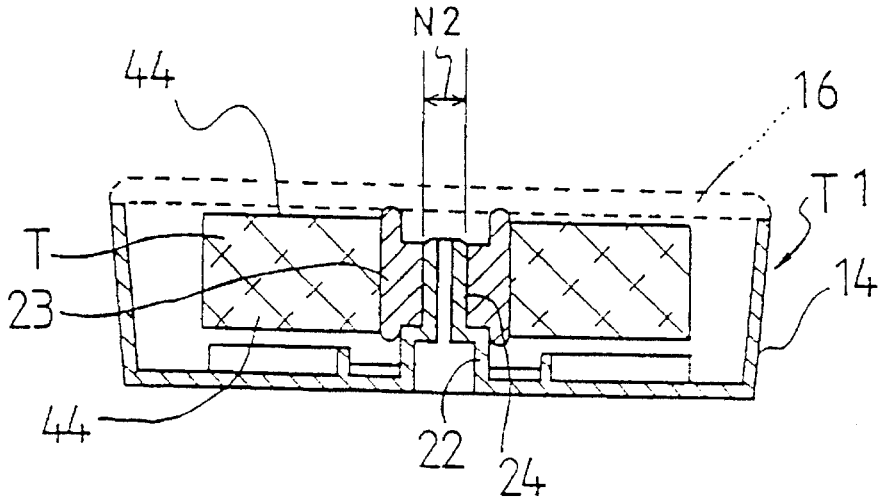
FIG. 14 is a cross sectional view showing a state of the narrow tape cassette in which the tape wound around another tape spool is housed.
Figure 15:
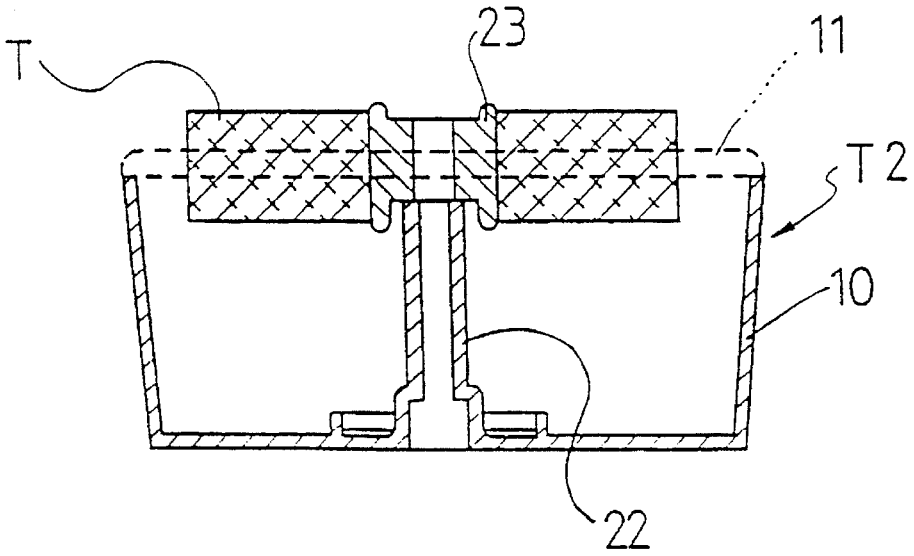
FIG. 15 is an illustrative representation showing a state where the tape spool to be housed in the narrow tape cassette is tried to be housed in the wide tape cassette.
Figure 16:
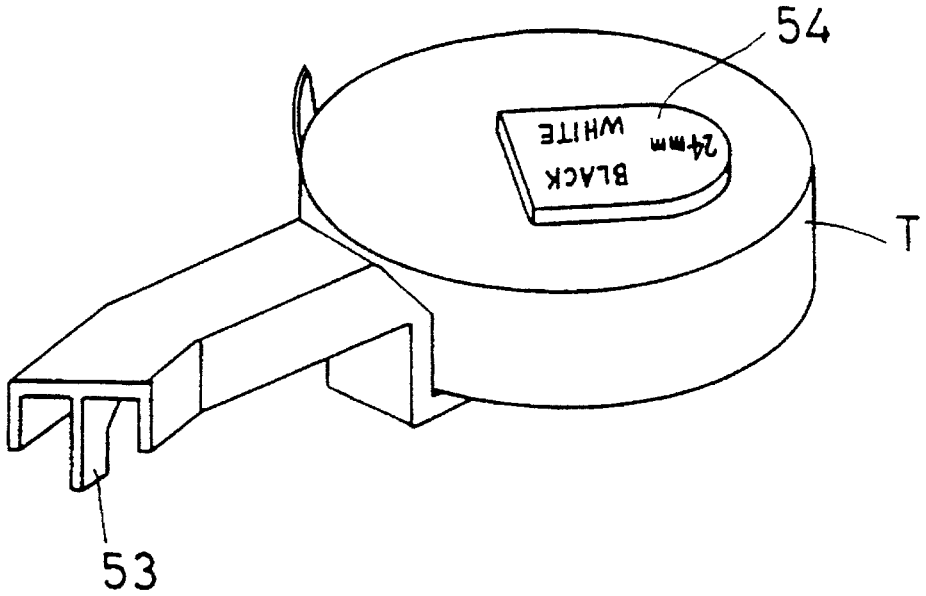
FIG. 16 is a perspective view showing a state where the tape is wound around the tape spool in the tape cassette and a sensor part is further added.
Figure 16:
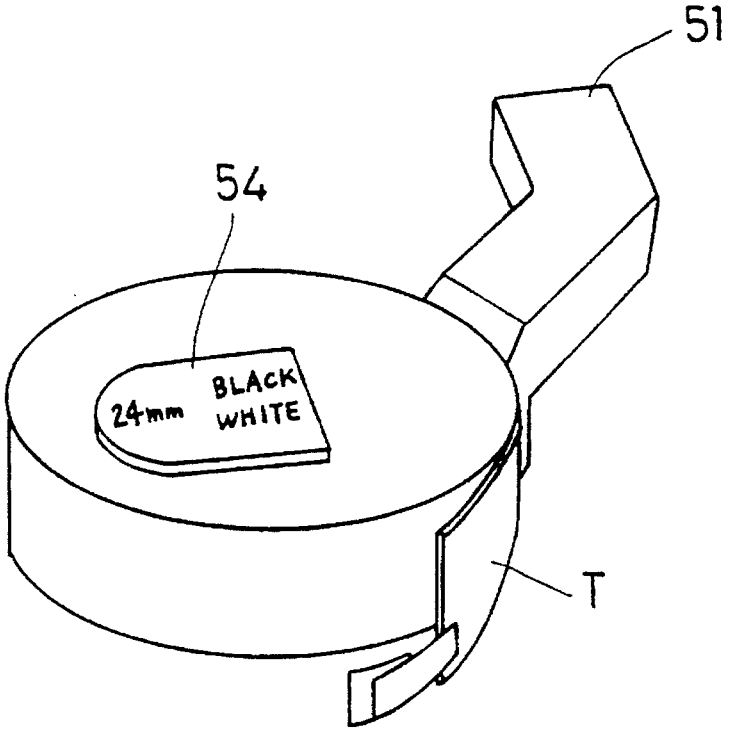
Figure 17:
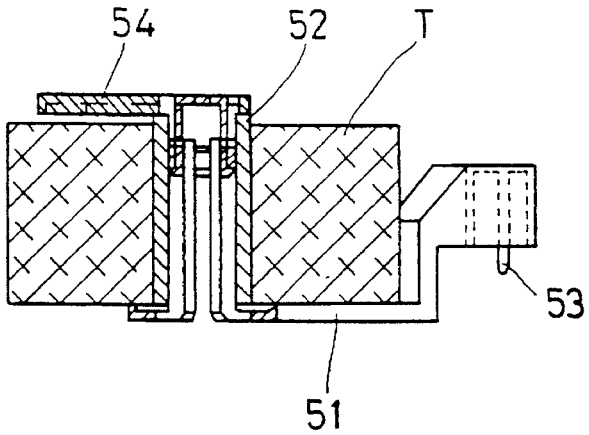
FIG. 17 is a cross sectional view showing a state of the tape and the tape spool added with the sensor part.

In FIG. 14, the inner diameter of the spool hole 24 formed at the center of the tape spool 23 is set to be N2, and the outer diameter of the tape supporting shaft 22, which is provided in a standing state on the bottom surface of the cassette main body 14, is also set to be approximately N2 (in the order that the tape spool 23 can be rotated on the tape supporting shaft 22). N2 (the inner diameter of the spool hole 24 of the tape spool 23 and the outer diameter of the tape supporting shaft 22 in the case of the narrow tape cassette T1) is set to be smaller than N1 (the inner diameter of the spool hole 24 of the tape spool 23 and the outer diameter of the tape supporting shaft 22 in the case of the wide tape cassette T2) (N1>N2). Therefore, when a user intends to engage the tape spool 23 for the narrow tape cassette T1 with the tape supporting shaft 22 for the wide tape cassette T2, as shown in FIG. 15, it is impossible to engage the tape spool 23 for the narrow tape cassette T1 with the tape supporting shaft for the wide tape cassette T2, which makes it possible to prevent securely the tape spool 23 for the narrow tape cassette T1 from being set erroneously to the tape supporting shaft 22 of the wide tape cassette T2.

As described in the above, the inner diameter N1 of the spool hole 24 of the tape spool 23 for the wide tape cassette T2 is arranged to be larger than the outer diameter of the tape supporting shaft 22 for the narrow tape cassette T2, so that the tape spool 23 for the wide tape cassette T2 can be inserted to the tape supporting shaft 22 of the narrow tape cassette T1, but in that case, the tape spool 23 protrudes upward from the cassette main body 14, and it becomes impossible to fit the cassette lid 16 in the cassette main body 14. Therefore, in that case also, it is securely prevented that the tape spool 23 for the wide tape cassette T2 is erroneously inserted to the tape supporting shaft 22 for the narrow tape cassette T1. Thus, it is completely prevented that the tape spool 23 for the narrow tape cassette T1 is set erroneously to the wide tape cassette, and vice versa.

Seals 44 applied with an adhesive agent are stuck on the upper end surface and the lower end surface of the tape T so that the surfaces of the seals 44 applied with an adhesive agent and the upper and lower end surfaces of the tape T can be stuck to each other. The seals 44 are adapted to maintain the wound state of the tape T wound around the tape spool 23, preventing the tape T from loosening. Further, in the same way as described above, a display portion, not shown, for displaying the color, etc. which can be colored on the tape T wound around the tape spool 23 is formed on the seal 44 stuck on the upper end surface of the tape T. Therefore, when the tape T is replaced, it is made possible to reload the tape T which meets to the tape cassette T1 without fail by confirming the kind of tape T on the display portion.

When the tape T is used up which is wound around the tape spool 23 housed in the narrow tape cassette T1 or the wide tape cassette T2 which is constituted as described above, the tape spool 23 with the used tape T is replaced with a tape spool 23 wound with an unused new tape T. When the tape spool 23 is to be changed, at first, the lid 6 is opened by turning the rotary lock member 8 of the tape printer P, and after the tape cassette T1 or T2 is taken out from the tape cassette installation portion 1, the cassette lid 11 or 16 is removed from the cassette main body 10 or 14 through the attachable/detachable portion 13 or 15. Then, the tape spool 23 is removed from the tape housing portion 21 of the cassette main body 10 or 14.

In that case, in the case of the tape cassette T1 or T2 as shown in FIGS. 9 or 11, at first, the cap 30 is pulled off from the gap S1 or S2, and then, the tape spool 23 is removed from the tape supporting shaft 22. In the case of the tape cassette T1 or T2 as shown in FIGS. 13 or 14, the tape spool 23 can be directly removed from the tape supporting shaft 22. In such a way, the tape spool 23 with the used tape is removed from the cassette main body 10 or 14.

Following the above, the tape spool 23 around which a new unused tape T is wound is fixed to the tape supporting shaft 22 of the cassette main body 10 or 14. When the tape spool 23 is to be fixed, in the case of the tape cassette T1 or T2, as shown in FIGS. 9 or 11, at first, after the tape spool 23 is inserted to the tape supporting shaft 22, the cap 30 is fit in the gap S1 or S2. In that case, the wall thickness of the cap 30 to be used for the wide tape cassette T2 is formed corresponding to the gap S1, and the wall thickness of the cap 30 to be used for the narrow tape cassette T1 is formed corresponding to the gap S2; therefore, there is no fear that the cap 30 is erroneously fixed to the wide tape cassette T2 by mistaking it for the narrow tape cassette T1, and vice versa.

In the present embodiment, the cap 30 is treated to be removable, but it can be fixed to the tape spool 23 and the dimensional relation between the inner diameter of the cap 30 and the outer diameter M1 or L1 of the tape supporting shaft 22 may be so arranged that the cap 30 can be rotated on the tape supporting shaft 22. The cap 30 and the spool 23 may be formed to be unity.

In the case of the tape cassette T1 or T2 as shown in FIGS. 13 and 14, each tape spool 23 is directly engaged with each tape supporting shaft 22. In that case, the inner diameter of the spool hole 24 of each tape spool 23 (N1 in the case of the wide tape cassette T2, and N2 in the case of the narrow tape cassette T1) corresponds to the outer diameter (N1) of the tape supporting shaft 22 in the case of the narrow tape cassette T1 or to the outer diameter (N2) of the tape supporting shaft 22 in the case of a wide tape cassette T2; therefore, as described in the above, there is no fear that the wrong tape spool 23 is erroneously fixed to the tape cassette T1 or T2.

A new tape spool 23 is housed in the tape housing portion 21 in the tape cassette T1 or T2 and after the tape T is guided by the tape guides 25, 26, 27 and 28 to the tape discharge portion A, the cassette lid 11 or 16 is fitted in the cassette main body 10 or 14; thus the installation of the tape spool 23 for the tape cassette T1 or T2 is finished. When the tape cassette T1 or T2 is installed in the cassette tape installation portion 1, it becomes possible to manufacture a new tape with characters through the tape printer P.

As explained in detail in the above, in the case of the tape cassette T1 or T2 in the present embodiment, when the tape T wound around the tape spool 23 is used up, the new tape spool 23 wound with the tape T can be reloaded for each of the tape cassette T1 or T2 and when the tape spool 23 is to be reloaded, it does not occur that the tape spool to be housed in the tape cassette T1 or T2 is erroneously housed in the wrong tape cassette, and the tape spool 23 can be properly reloaded to the corresponding tape cassette T1 or T2.

As described in the above, the waste concerning the tape cassette can be avoided and the cost in manufacturing the tape with characters can be saved much.

The present invention is not limited to the above-mentioned embodiments, and various improvements and modifications may be made according to the invention without departing from the spirit and the scope thereof.

For example, a tape T to be reloaded may have a sensor part 51 to make the tape printer P recognize the kind of tape T.

The sensor part 51 has a shaft which can be inserted into the spool hole of a tape spool 52 from the bottom, around which the tape T is wound, and it extends from the spot toward the outer periphery of the tape T with the shape of a handle. A wall 53 which shows the kind of tape T is provided on the lower surface of the end part of the handle part. There is provided a fixing hole at the center of the shaft to be engaged with the spool hole. Further, there is a cap 54 on the upper surface of the tape spool, and the cap, on which the kind of tape is written, is inserted into the spool hole from the upper side and it is engaged with the sensor part 51 in the spool hole. The tape spool 52 is placed between the cap 54 and the sensor part 51 and its movement in the vertical direction is restrained but it is held rotatably.

Figure 18:
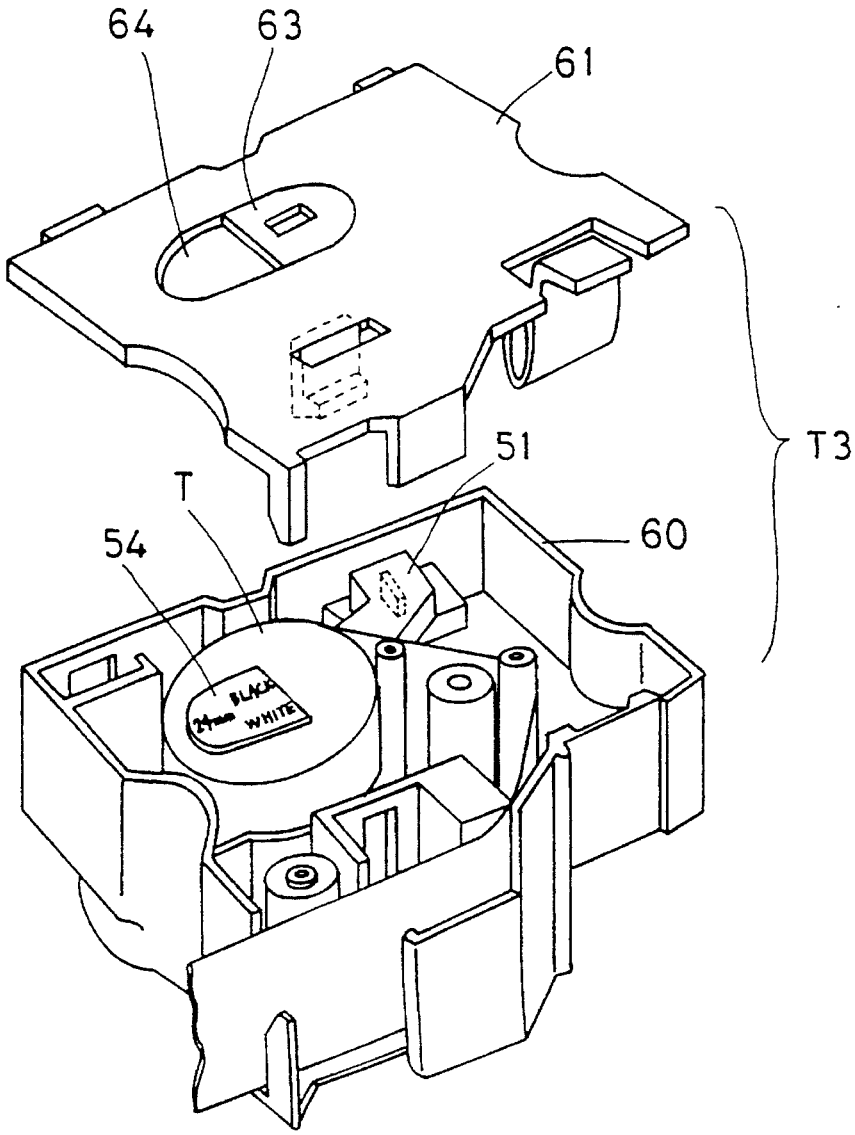
FIG. 18 is a perspective view for illustrating a state where the tape added with the sensor part is housed in the tape cassette.

As shown in FIG. 18, when a tape T is installed in a tape cassette T3, a tape supporting shaft provided on a cassette main body 60 is fitted in the fixing hole of the sensor part 51 and the wall 53 of the sensor part 51 is inserted to penetrate a predetermined part on the bottom surface of the cassette main body; thereby, the position of the tape T in the cassette main body 60 is decided. A visual confirmation hole 64, having a size similar to that of a cap 54, is formed on a confirmation portion 63 of a cassette lid 61, and the cassette lid 61 is fixed on the cassette main body 60 so that the cap 54 can be fitted in the visual confirmation hole 64.

When the tape cassette T3 is installed on the tape printer P, the wall 53 of the sensor part 51 is sensed by a sensor provided in the tape printer P and the kind of tape T is recognized. The tape printer P performs the printing matching with the kind of tape T.

As described in the above, it is made possible according to the present invention to offer the tape unit in which the tape to be reloaded can be easily discriminated with the display member provided on the tape unit, and owing to the position at which the display member is fixed, the proper tape unit can be properly reloaded to the corresponding tape cassette without mistaking the direction of the tape unit.

What is claimed is:

1. A tape cassette housing a removable tape unit, the removable tape unit comprising:

a tape spool having a spool hole to be rotatably engaged with a tape supporting shaft provided on an inner surface of the tape cassette, said tape spool having an upper end and a lower end;

a tape wound around said tape spool, said tape and said tape spool being removable from said tape cassette; and a rotatably mounted display member fitted within said spool hole on said upper end of said tape spool for displaying the kind of wound tape on a part of said tape unit.

2. A tape cassette according to claim 1, wherein said display member displays at least one of a ground color of said tape, a color of possible coloring in printing, a use of said tape or a width of said tape.

3. A tape cassette according to claim 2, wherein said display member is a cap-shaped member to be fitted in said spool hole in an upper end of said tape spool, wherein said cap-shaped member is located on a center axis of the tape spool so as to see said cap-shaped member through a window of the tape cassette at any rotation position of said tape wound around said tape spool.

4. A tape cassette according to claim 3, wherein a length of said cap-shaped member, extending from said upper end of said tape spool towards the lower end of said tape spool, corresponds to the width of said tape to prevent said tape unit from being wrongly inserted into a noncorresponding tape cassette.

5. A tape cassette according to claim 2, wherein a thickness of said tape unit, measured from said upper end of the tape spool to the lower end of said tape spool, prevents said tape unit from being wrongly inserted into a noncorresponding tape cassette.

6. A tape cassette according to claim 1, further comprising seals stuck to one surface of said tape wound around said tape spool.

7. A tape cassette according to claim 1, wherein the tape unit further comprises a sensor device corresponding to the kind of the tape.

8. A tape cassette according to claim 7, wherein said display member displays at least one of a ground color of said tape, a color of possible coloring in printing, a use of said tape and a width of said tape.

9. A tape cassette according to claim 7, wherein said sensor device further comprises a wall penetrating a predetermined part on a bottom surface of the tape cassette to position the tape unit.

10. A tape cassette according to claim 9, wherein said wall of said sensor device is detected by a sensor of a tape printer so that the tape printer corresponds with the kind of said tape.

11. A tape cassette housing a removable tape unit, the removable tape unit comprising:

a tape spool having a spool hole to be rotatably engaged with a tape supporting shaft provided on an inner surface of the tape cassette;

a tape wound around said tape spool, said tape and said tape spool being removable from said tape cassette;

a display member for displaying the kind of wound tape on a part of said tape unit; and a sensor device including a shaft inserted into said spool hole at a lower end of said tape spool and a handle part extending to an outer periphery of the tape wound around the tape spool, said handle part including a wall protruding from said handle part to indicate the kind of said tape.

12. A tape cassette comprising:

a removable tape unit comprising a tape spool having a spool hole to be rotatably engaged with a tape supporting shaft provided on an inner surface of the tape cassette, a tape wound around said tape spool, said tape and said tape spool being removable from said tape cassette, and a rotatably mounted display member, said tape spool having an upper end and a lower end, the display member being fitted within said spool hole on said upper end of said tape spool for displaying the kind of wound tape;

a cassette lid detachable from a cassette main body for removing said removable tape unit stored in said tape cassette; and a visual confirmation portion for confirming the kind of the tape stored in said tape cassette, said visual confirmation portion disposed on a surface of said cassette lid, wherein said display member is seen through said visual confirmation portion.

13. A tape cassette according to claim 12, wherein said display member displays at least one of a ground color of said tape, a color of possible coloring in printing, a use of said tape and a width of said tape.

14. A tape cassette according to claim 12, wherein said display member is a cap-shaped member to be fitted in said spool hole in the upper end of said tape spool, wherein said cap-shaped member is located on a center axis of the tape spool so as to see said display member through said visual confirmation portion of said tape cassette at any rotation position of said tape.

15. A tape cassette according to claim 12, wherein said display member is a cap-shaped member which is fitted in said spool hole when a tape width displayed by said cap-shaped member corresponds to a width of said tape wound around said tape spool.

16. A tape cassette according to claim 12, further comprising seals stuck to one surface of said tape.

17. A tape cassette according to claim 12, wherein said removable tape unit further comprises a sensor device corresponding to the kind of the tape.

18. A tape cassette according to claim 17, wherein said sensor device further comprises a wall penetrating a predetermined part on a bottom surface of the tape cassette for positioning the tape unit, said wall of said sensor device is detected by a sensor of a tape printer so that the tape printer corresponds with the kind of said tape.

19. A tape cassette comprising:

a removable tape unit comprising a tape spool having a spool hole to be rotatably engaged with a tape supporting shaft provided on an inner surface of the tape cassette, a tape wound around said tape spool, said tape and said tape spool being removable from said tape cassette, a display member for displaying the kind of wound tape, and a sensor device including a shaft inserted into said spool hole at a lower end of said tape spool and a handle part extending to an outer periphery of the tape wound around the tape spool, said handle part including a wall protruding from said handle part to indicate the kind of said tape;

a cassette lid detachable from a cassette main body for removing said removable tape unit stored in said tape cassette; and a visual confirmation portion for confirming the kind of the tape stored in said tape cassette, said visual confirmation portion disposed on a surface of said cassette lid, wherein said display member is seen through said visual confirmation portion.

20. A tape printer comprising:

a tape cassette storing a removable tape unit, the removable tape unit comprising a tape spool having a spool hole to be rotatably engaged with a tape supporting shaft provided on an inner surface of the tape cassette, a tape wound around said tape spool, said tape and said tape spool being removable from said tape cassette, and a rotatably mounted display member, said tape spool having an upper end and a lower end, said display member being fitted within said spool hole on said upper end of said tape spool for displaying the kind of wound tape, said tape cassette having a visual confirmation portion for confirming the kind of said tape; and a window for showing said display member through said visual confirmation portion, said window disposed on a top surface of said tape printer.

21. A tape printer according to claim 20, wherein said tape cassette comprises a cassette lid detachable from a cassette main body for removing said removable tape unit stored in said tape cassette, said visual confirmation portion is disposed on the surface of said cassette lid.

22. A tape printer comprising:

a tape cassette storing a removable tape unit, the removable tape unit comprising a tape spool having a spool hole to be rotatably engaged with a tape supporting shaft provided on an inner surface of the tape cassette, a tape wound around said tape spool, said tape and said tape spool being removable from said tape cassette, a display member for displaying the kind of wound tape, and a sensor device including a shaft inserted into said spool hole at a lower end of said tape spool and a handle part extending to an outer periphery of the tape wound around the tape spool, said handle part including a wall protruding from said handle part to indicate the kind of said tape, said tape cassette having a visual confirmation portion for confirming the kind of said tape;

a window for showing said display member through said visual confirmation portion, said window disposed on a top surface of said tape printer; and a sensor for detecting the kind of said tape by detecting said sensor device of said removable tape unit.

23. A tape printer according to claim 22, said removable tape unit comprises a wall indicating the kind of said tape, said wall penetrating a predetermined part on a bottom surface of the tape cassette for positioning the removable tape unit, said wall of said sensor device is detected by said sensor of the tape printer so that the tape printer corresponds with the kind of said tape.

24. A removable tape unit structured to be removable from a tape cassette, the removable tape unit comprising:

means for enabling said tape unit to be removable from said tape cassette;

a tape spool having a spool hole to be rotatably engaged with a tape supporting shaft provided on an inner surface of the tape cassette, said tape spool having an upper end and a lower end;

a tape wound around said tape spool, said tape and said tape spool being removable from said tape cassette; and a rotatably mounted display member fitted within said spool hole on said upper end of said tape spool for displaying the kind of wound tape on a part of said tape unit.

25. A removable tape unit according to claim 24, wherein said display member displays at least one of a ground color of said tape, a color of possible coloring in printing, a use of said tape or a width of said tape.

26. A removable tape unit according to claim 24, wherein said tape unit further comprises a sensor device corresponding to the kind of the tape.

27. A removable tape unit according to claim 24, wherein said enabling means comprises a connecting portion removably engageable with a corresponding connecting portion of said tape cassette.

28. A removable tape unit structured to be removable from a tape cassette, the removable tape unit comprising:

a tape spool having a spool hole to be rotatably engaged with a tape supporting shaft provided on an inner surface of the tape cassette;

a tape wound around said tape spool, said tape and said tape spool being removable from said tape cassette;

a display member for displaying the kind of wound tape on a part of said tape unit; and a sensor device corresponding to the kind of the tape, wherein the sensor device further comprises a shaft inserted into said spool hole at a lower end of said tape spool and a handle part extending to an outer periphery of the tape wound around the tape spool, said handle part including a wall penetrating a predetermined part on a bottom surface of a tape cassette to position the removable tape unit.

29. A removable tape unit according to claim 28, wherein said wall of said sensor device is detected by a sensor of a tape printer so that the tape printer corresponds with the kind of said tape.

* * * * *